United States Patent [19]

Merz

[11] Patent Number: 4,832,764

[45] Date of Patent: May 23, 1989

[54] PROCESS FOR THE LOW-DISTORTION THERMOMECHANICAL TREATMENT OF WORKPIECES IN MASS PRODUCTION AS WELL AS APPLICATION OF THE PROCESS

[75] Inventor: Peter Merz, Wiesendangen, Switzerland

[73] Assignee: Jenny Pressen AC, Frauenfeld, Switzerland

[21] Appl. No.: 940,762

[22] PCT Filed: Mar. 6, 1986

[86] PCT No.: PCT/CH86/00028

§ 371 Date: Dec. 22, 1986

§ 102(e) Date: Dec. 22, 1986

[87] PCT Pub. No.: WO86/05820

PCT Pub. Date: Oct. 9, 1986

[51] Int. Cl.[4] ..... C21D 8/00

[52] U.S. Cl. ..... 148/131; 148/154; 72/341

[58] Field of Search ..... 148/131, 12.4, 150, 148/154; 72/342

[56] References Cited

U.S. PATENT DOCUMENTS 3,668,917 6/1972 Komats et al. ..... 72/342
3,703,093 11/1972 Komatsu et al. ..... 72/342
3,753,798 8/1973 Komatsu et al. ..... 148/131

FOREIGN PATENT DOCUMENTS 2003306 1/1970 Fed. Rep. of Germany .
2003305 1/1970 Fed. Rep. of Germany .
1598224 8/1970 France .

OTHER PUBLICATIONS

Article Translated from Metallovedenie i Termicheskaya Obrabotka Metallov, No. 9, pp. 18–23, Sep. 1976.

*Primary Examiner*—Christopher W. Brody
*Attorney, Agent, or Firm*—Hovey, Williams, Timmons & Collins

[57] ABSTRACT

In the system, heating device (2), quenching press (4), tempering device (6), and cooling device (8) are connected one directly after the other in such a way that the workpieces (10) pass through the individual stations with specified cycle times and without heat loss. The temperature-time response during the individual treatment steps is controlled by means of a central program control in accordance with a specified program determined by testing and/or calculation. The system is especially suitable for use in the fully automatic, thermomechanical treatment in mass production of disk springs, especially those which have a greater hardness at the free ends of the lamellae than in the remaining areas.

14 Claims, 7 Drawing Sheets

Fig.1

Figure 1:
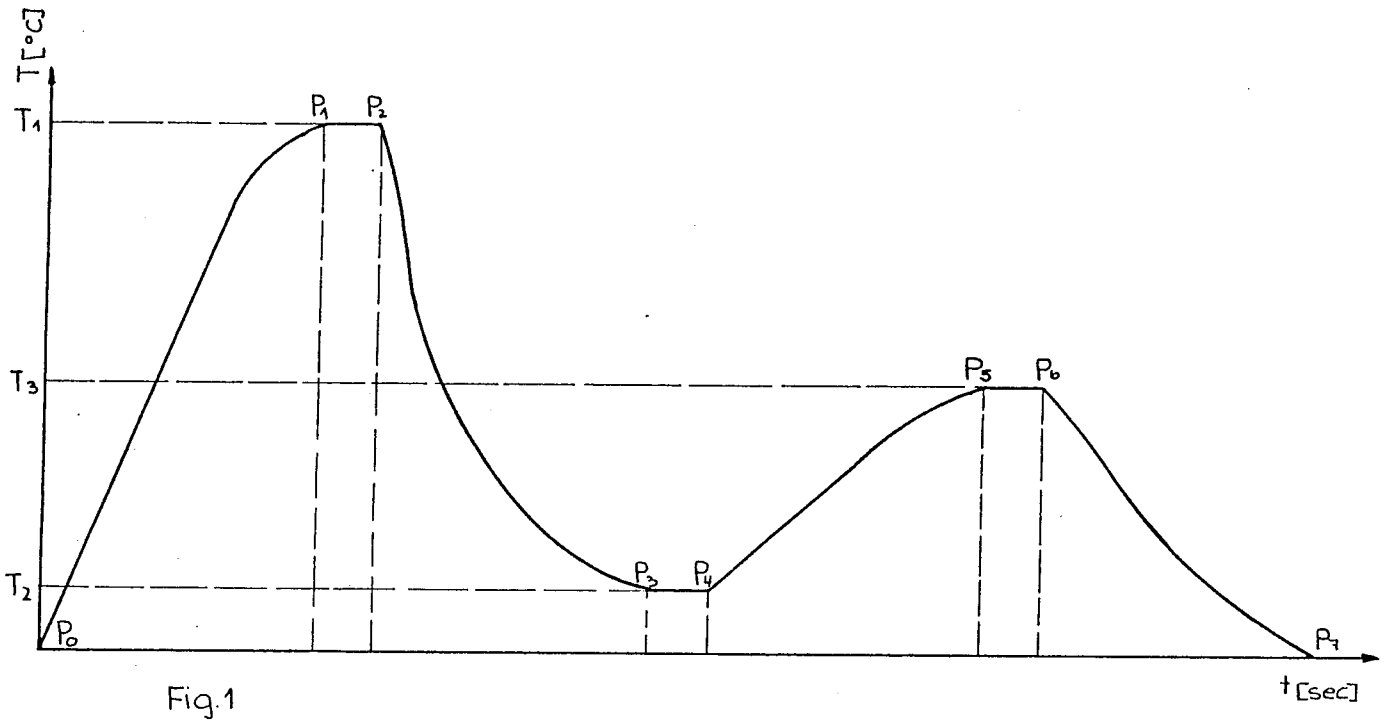

PROCESS FOR THE LOW-DISTORTION THERMOMECHANICAL TREATMENT OF WORKPIECES IN MASS PRODUCTION AS WELL AS APPLICATION OF THE PROCESS

The invention concerns a process in accordance with the superimposed concept of Patent claim 1 as well as a system for implementation of the process and an application of the process.

For attaining the properties such as hardness, viscosity, wear resistance, fatigue resistance required for a particular application, workpieces of hardenable metallic materials, particularly iron materials such as steels, are commonly subjected to a process of hardening/tempering. The process of hardening/tempering generally comprises several treatment steps, i.e. a hardening treatment by quenching a workpiece heated to hardening temperature and a subsequent controlled heat treatment such as annealing, tempering, or holding at a sepcified temperature and/or controlled cooling.

In order to prevent the workpiece from being subject to a change in its shape and/or its dimensions during the process of hardening/tempering, i.e. from becoming distorted, a quenching press is used in which the workpiece is chucked and quenched in its chucked state. In known processes, quenching is achieved using quenching presses in which a liquid quenching medium circulates around the workpiece. The selection of the quenching medium for this purpose depends upon its thermal capacity and the size of the temperature drop to be set, in particular the quenching speed. In general, water, saline solutions, or oils are used as quenchants. When using liquid quenchants, in particular saline solutions or oils, it is disadvantageous that after quenching the quenchant-contaminated workpiece must be cooled to near room temperature and washed before it can be subjected to the subsequent heat treatment step, heating to tempering temperature, for example. This intermediate treatment by washing is not only time-consuming and labor-intensive, but can even lead to stresses and deformation of the workpieces.

Particularly complicated is the manufacture and hardening of disk springs such as those used for clutches in the automobile industry. Such disk springs are heated to hardening temperature, if necessary preceded by cold forming of the slugs in the furnace, and then quenched in an oil bath or in quenching presses, then cooled, cleaned of oil and tempered. In these processes, deformations cannot be avoided. Various post-treatment processes are complicated and costly and, nevertheless, do not bring about any significant improvement.

Exceptionally problematic and costly is the manufacture of disk springs which have lamellae projecting radially inward from an outer closed annular part, (lamellae)* the ends of which require greater hardness than the remainder of the disk springs. In order to produce areas of differential hardness, such workpieces must be subjected to a separate treatment after completion of the hardening process. Either the areas in which greater hardness is desired are coated with a resistant material such as molybdenum, or they are hard-chromium plated, or the disk spring is subjected to a second complete hardening treatment for the area of greater hardness. Such additional treatments are in every case complicated and costly and involve an additional risk of deformation of the disk spring.

It is known that the structure of a workpiece obtained by means of a thermomechanical treatment determines its mechanical properties such as hardness, viscosity, mechanical resistance, fatigue resistance. In addition to the composition, the formation of a certain structure, in turn, depends, however, primarily upon the metallurgical parameters applied during heat treatment. Thus, it is only by their exact setting and adherence to them that the formation of a structure can be achieved which is endowed with the required properties. Disadvantages demonstrated in the processes known to this time, have been in particular the needed long heating and cooling periods, the long conveying periods between the individual treatment stations and the difficulty of exactly controlling the time-temperature response required in these processes.

The object of the invention is, therefore, indicating a process and a system which permit a low-distortion thermomechanical treatment of plane workpieces in mass production, in particular those of small thickness and, as necessary, areas of differential hardness with lower work, time, and energy requirements in comparison to the known processes and which offer the possibility of obtaining products with a predetermined structure and the desired properties, with their application allowing in particular an economical manufacture of disk springs.

In accordance with the invention, the set objective is accomplished by the processes defined in the characterizing portion of claims 1 and 11 and by the system defined in the characterizing portion of claim 15 and by application of the process in accordance with claim 30.

In the first treatment station, the use of inductive heating, which allows extremely brief heating periods of only a few seconds and can be precisely controlled, leads to considerable reduction in time required in comparison to traditional heating in a furnace. This represents a particular advantage of the present process.

Since, in this process, the workpiece to be treated does not enter into contact with liquid quenchants such as oil or aqueous saline solutions in the hardening stage, the complicated and mostly intermediate treatment such as cooling to a temperature considerably below the tempering temperature, generally to near room temperature, as well as washing and removal of adhering quenchants such as oil or aqueous saline solutions, necessary in the known processes, is omitted. In this manner, a considerable reduction in the required work and energy can be attained in comparison to the known processes, and a burden on the environment can be almost completely avoided.

Another advantage of this process can be seen in the fact that the third treatment stage, i.e. the tempering treatment, is carried out immediately following the second treatment stage, the quenching process, and that the workpiece is subjected to a tempering treatment in a chucked state, without intermediate cooling and/or intermediate treatment.

By quenching to a specified temperature above room temperature and a directly subsequent tempering treatment, the formation of stress cracks can be completely avoided.

Another advantage of the present process can be seen in the fact that immediately after leaving the tempering device in the third treatment stage, the workpiece is carried to the fourth treatment stage where it is subjected to controlled cooling in a chucked state. In this manner, excellent dimensional stability of the workpiece is assured.

As an exceptional advantage, it must be stressed that by setting the temperature-time response during the individual treatment steps by means of a central program control in accordance with a specified program determined by tests and/or calculations, it is possible to consistently obtain products which have the desired structure in an excellent quality, are free of stress cracks, and have properties such as hardness, viscosity, wear resistance, fatigue resistance which correspond exactly to the set requirements and exceed previously attainable results. In particular, the possibility exists to bring about an exact adjustment of the desired structure by precisely setting the quenching end temperature.

Advantageous embodiments of the process are described in claims 2 through 10 and 12 through 14, of the system in claims 16 through 29, and of the application in claim 31.

Particularly good results with respect to the structure and the properties of the workpiece can be attained by means of the embodiment in accordance with claim 2.

It is particularly advantageous if the time for conveying the workpiece from treatment station to treatment station is extremely brief, in order to avoid heat losses, in particular between heating station and hardening station. For this purpose, an embodiment in accordance with claim 3 is advantageous. To that effect, the conveying period between the treatment stations is set in such a way that no damaging structural change occurs in the workpiece. The conveying period for large and thick workpieces can be greater than for the thin and small ones.

Claim 4 describes an advantageous embodiment of the heat treatment, in which heat elimination control can be carried out in accordance with claim 5.

A particularly precise and adaptable control of heat elimination is described in claim 6.

The embodiment in accordance with claim 7 makes it possible to obtain workpieces which are free from stress cracks and which have a structure which has exactly the desired mechanical and metallurgical properties required for the intended application in the individual case.

Finally, it is possible to avoid the formation of stresses in the workpiece by periodically changing the pressure applied by the quenching press in accordance with claim 8.

It is exceptionally advantageous to proceed in accordance with claim 9, by which it is possible to obtain areas of differential hardness in a workpiece by means of a single tempering treatment.

The embodiment of the process in accordance with claim 10 allows exact control of the process course in accordance with a program, calculated or determined by tests; this allows practically complete automation of the thermomechanical treatment. Whether the workpieces are transported from a treatment station by means of conveying devices—generally preferred—or whether the workpieces are made to run through the individual stations subject to the effect of gravity depends in each individual case essentially upon the dimensions of the workpiece to be treated.

The process in accordance with claim 11 is distinguished by particular simplicity since, in this case, only two treatment stations are required. In this case, the inductive heating in the first stage takes place in the same manner as with the process in accordance with claim 1. Cooling in the quenching press is also carried out in the same manner as with the process in accordance with claim 1, except that the quenched workpiece is subjected to a tempering treatment and/or a controlled cooling, in particular delayed cooling, in the quenching press. In this case, the setting of the temperature-time response in accordance with a specified metallurgical program determined by tests and/or calculations allows once again an exact adjustment to the required values.

The design in accordance with claim 12, in which the workpiece is subjected to an isothermal heat treatment after quenching, and the design in accordance with claim 13, the so-called BY-treatment, have proven particularly advantageous in this respect. The latter generally produces a structure of great hardness with high viscosity and/or wear resistance.

In order to increase the resistance to aging of the workpieces manufactured in accordance with the process of the type mentioned in the beginning and, above all in the case of clutch springs, to prevent the spring tension from declining during operation as a result of the thermal load generated by heat development in the engine, the embodiment in accordance with claim 14 is recommended. By exerting brief flattening or excess pressure generally lasting a few seconds, on the workpiece which has been cooled to 200° C. and subsequent cooling in the chucked state, artificial aging is caused by which a considerable improvement of resistance to aging, up to 50%, and thus of the elastic characteristic can be attained.

This embodiment has the particular advantage that the measure can be integrated into the process development and incorporated into the process control without any difficulty. This is a considerable step forward in comparison to conventional processes because in these processes, an additional thermal setting of the finished springs had to be accomplished before assembly. Thermal setting, during which the springs were treated in lots in an oven at 150° to 220° C. for 1 to 2 hours, was carried out manually and thus required considerable investment in time and labor.

In comparison to known systems, this system offers considerable advantages, because, as a result of the arrangement of the heating device, the quenching press, the tempering device, and the cooling device in direct succession, the workpieces to be hardened can cover the stretches between the individual treatment stations in a minimal amount of time so that interference caused by unintentional localized cooling can be completely avoided and continuous thermomechanical treatment is possible in one operation. Moreover, the hardened workpieces are distinguished by a high degree of dimensional stability and a uniform and very fine-grained structure. This achieves not only a considerable reduction in investment of labor and cost, but leads in particular to the avoidance of the disadvantages which occur when known systems are used, including inadequate dimensional stability and irregular structure of the workpieces as well as additional forming, thermal treatment, cleaning, hardening and tempering steps.

The heating device can be designed as desired. Particularly preferred, however, is an embodiment in accordance with claim 16. It allows heating the workpieces with great uniformity and a precisely adjustable temperature/time sequence. In accordance with the requirements of the individual case, the heating device can be operated at medium frequency or high frequency. The embodiment in accordance with claim 17 is preferable for cases in which heating in a protective gas atmosphere such as nitrogen is expedient.

The design in accordance with claim 18 offers the possibility of a particularly clean operating method, because the use of quenchants such as oil or saline solutions which contaminate the workpieces and/or the environment can be avoided.

By means of an embodiment of the system in accordance with claim 19, the dimensional accuracy of the hardened workpiece can be improved, while the embodiment in accordance with claim 20 permits exact control of the temperature-time response and its adjustment to the requirements in each case.

The embodiment in accordance with claim 21 allows locally differentiated heating during the tempering process, thereby making it possible to attain areas of varying hardness in the workpiece, with the possibility to reinforce the desired effect even more by means of the design in accordance with claim 22.

The embodiment in accordance with claim 23 allows particularly cautious cooling of the formed, hardened, and tempered workpieces and makes it possible to put the workpieces to their use immediately after removal from the system, without any further additional treatments.

The embodiment in accordance with claim 24 is of particular advantage for smaller flat workpieces because it allows particularly expedient conveying of the workpieces from treatment station to treatment station.

The system can, however, also be designed in such a way that the workpieces in the individual treatment stations are arranged horizontally and are transported from one treatment station to another in a horizontal position, too.

For conveying the workpieces between the individual treatment stations, the most varied possibilities exist. Particularly expedient is an embodiment in accordance with claim 25, in which advantageous movement, acceleration and delay conditions are generated if the cam is moved along a curved path, preferably along a circular path. A very simple solution for the conveying device is described in claim 26. In order to avoid heat losses due to the conveying device, an embodiment in accordance with claim 27 is very expedient.

For the thermomechanical treatment of very small, plane workpieces such as those of a diameter of a few centimeters, an embodiment of the system in accordance with claim 28 is advantageous. In this embodiment, heating device, quenching press, and tempering device are directly connected one behind the other, at descending levels in such a way that the workpieces pass through the individual stations subject to the effect of gravity. In this manner, a particularly rapid and contact-free conveyance of the workpieces is achieved.

The embodiment in accordance with claim 29 allows a fully automatic thermomechanical heat treatment of workpieces from the slug to the formed workpiece, ready for use, having the preferred structure and the desired properties.

The use of the process and the system for the manufacture of disk springs in accordance with claim 30 offers quite extraordinary advantages because, for the first time, it is now possible to harden disk springs in one operation, and that with a form accuracy and quality previously unknown, so that such disk springs can be put to further use without any post-treatment. In accordance with claim 31, disk springs which demonstrate greater hardness at the lamellae ends than in the remaining areas can also be manufactured in the same operation.

Sample embodiments of the invention are described in the following in greater detail based on the drawings showing the following:

FIG. 1: Temperature/time diagram for a thermomechanical treatment

Figure 2:
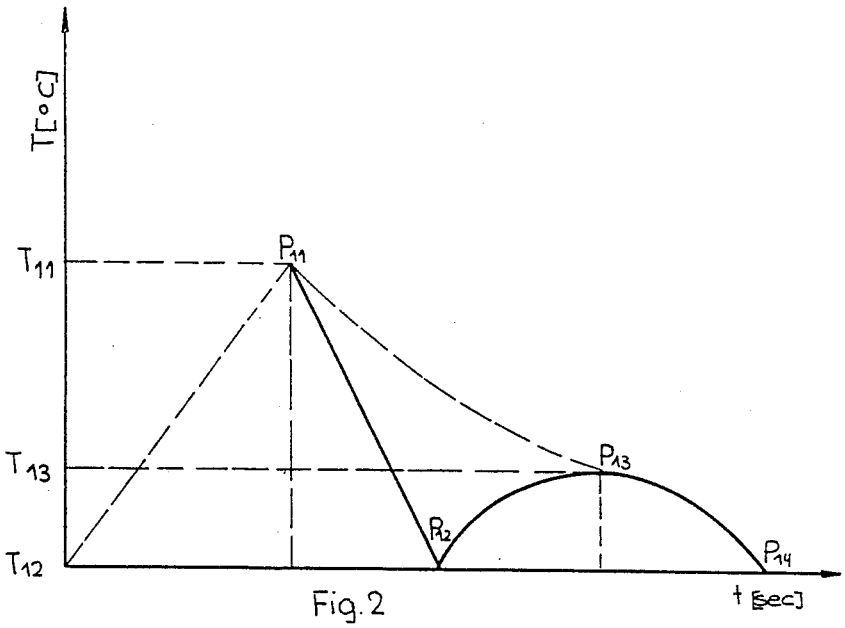

FIG. 2: Temperature/time diagram for direct hardening/tempering

Figure 3:
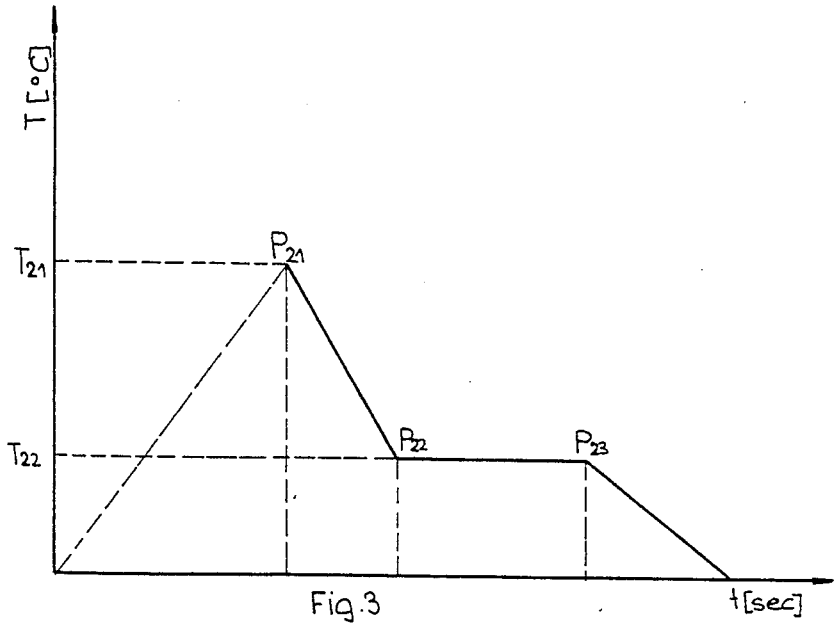

FIG. 3: Temperature/time diagram for isothermal heat treatment

Figure 4:
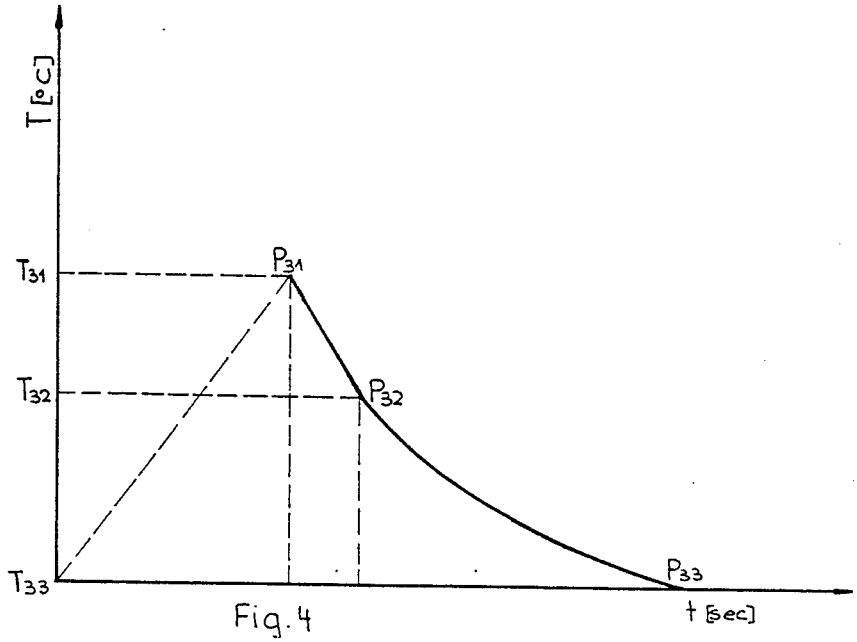

FIG. 4: Temperature/time diagram for BY-treatment

Figure 5:
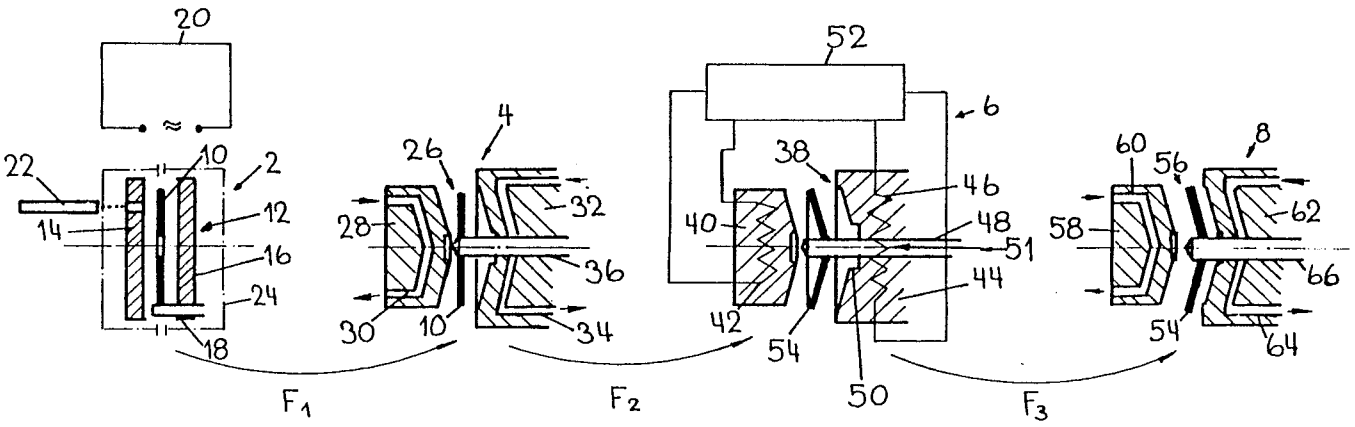
Figure 8:
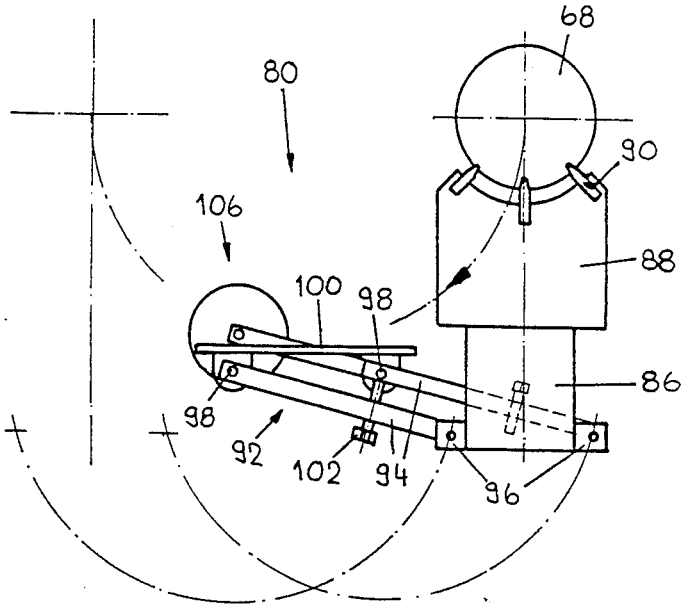

FIG. 5: A block diagram of a system for the thermomechanical treatment of plane workpieces in mass production FIG. 6: A disk spring as a sample of a workpiece to be manufactured using the system FIG. 7: The disk spring of FIG. 6 in a longitudinal section VII—VII;

FIG. 8: A conveying device for transferring workpieces between the treatment stations, with the view perpendicular to the direction of transport FIG. 9: The conveying device in accordance with FIG. 8 viewed in the direction of transport; and FIG. 10: Block diagram of another system for the thermomechanical treatment of plane workpieces in mass production.

The diagram shown in FIG. 1 shows the temperature-time response during the thermomechanical treatment of a plane workpiece in which a workpiece existing as a slug is subjected to heat transformation, hardening, tempering, and controlled cooling, if necessary. Before carrying out the process, the metallurgical parameters required for carrying out the thermomechanical treatment in an individual case are determined by tests or calculations based on the structure to be attained and entered into a central program control unit. For this purpose, the workpiece existing as a slug is inductively heated to austenitizing temperature $T_1$ and, while maintaining temperature $T_1$, is transferred to a quenching press and introduced into the same, formed and simultaneously quenched to a temperature $T_2$. Thereafter, while maintaining temperature $T_2$, the workpiece is transported to a tempering device, introduced into the same, and heated to a temperature $T_3$ in a chucked state, while maintaining temperature $T_3$, transported to a cooling device and introduced into it and, in a chucked state, cooled in it to room temperature. In this step, the curve of the temperature with reference to time during heating to austenitizing temperature $T_1$ follows the solid line from $P_0$ to $P_1$, that during the transfer to the quenching press, the solid line from $P_1$ to $P_2$. The curve of the temperature with reference to time during quenching from temperature $T_1$ to temperature $T_2$ corresponds to the solid line from $P_2$ to $P_3$, while, during the transfer to the tempering device, it follows the line from $P_3$ to $P_4$. The curve of the temperature with reference to time during heating in the tempering device follows the line from $P_4$ to $P_5$, while that during the transfer from the tempering device to the cooling device corresponds to the solid line from $P_5$ to $P_6$. The curve of the temperature with reference to time during cooling to room temperature follows the solid line from $P_6$ to $P_7$.

The slope of the curve shows that the partial distances from $P_1$ to $P_2$, from $P_3$ to $P_4$, and from $P_5$ to $P_6$ are small in comparison to the partial distances from $P_0$ to $P_1$, from $P_2$ to $P_3$, from $P_4$ to $P_5$, and from $P_6$ to $P_7$.

The diagram presented in FIG. 2 demonstrates the temperature/time sequence during heat treatment of a workpiece by direct hardening/ tempering, as preferably used for cases in which great surface hardness is desired. The metallurgical parameters required for carrying out the process are determined by tests before carrying out the process. The workpiece heated to a temperature $T_{11}$ is chucked in a quenching press in order to avoid deformations and quenched within a period of a few seconds as determined by tests. In doing so, the surface temperature is decreased to temperature $T_{12}$ and the core temperature to temperature $T_{13}$. In this connection, the curve of the surface temperature with reference to time corresponds to the solid line from $P_{11}$ to $P_{12}$, while the curve of the core temperature with reference to time corresponds to the broken line from $P_{11}$ to $P_{13}$. Subsequently, the surface temperature is increased to temperature $T_{13}$, the tempering temperature, by means of the existing residual heat and by the external supply of heat. Here, the temperature curve during heating corresponds to the solid line from $P_{12}$ to $P_{13}$, that for the subsequent cooling to the line connecting $P_{13}$ and $P_{14}$.

FIG. 3 shows the temperature/time sequence during an isothermal heat treatment, as preferably used for attaining a structure of medium hardness and high viscosity and wear resistance. The metallurgical parameters required for carrying out the process are predetermined by tests. The workpiece heated to a temperature $T_{21}$ is chucked in a quenching press to avoid deformations and quenched to a temperature $T_{22}$ within a period of time of a few seconds determined by tests. Here, the temperature curve corresponds to the solid line from $P_{21}$ to $P_{22}$. The workpiece is then held at a temperature $T_{22}$ during a period of time which corresponds to the distance $P_{22}$ to $P_{23}$ and subsequently permitted to cool.

The diagram presented in FIG. 4 shows the temperature/time sequence during a heat-treatment called BY-treatment, which is preferably used if the mechanical end values are to be attained by means of a single heat treatment operation. In the BY-treatment, the workpiece heated to a temperature $T_{31}$ is chucked in a quenching press in order to avoid deformations and quenched to a temperature $T_{32}$ during a period of time of a few seconds determined by tests. Here, the curve for the temperature with reference to time corresponds to the solid line from $P_{31}$ to $P_{32}$. Subsequently, the workpiece is subjected to controlled and, in particular, delayed cooling to a temperature $T_{33}$. In this case, the curve of the temperature with reference to time corresponds to the solid line from $P_{32}$ to $P_{33}$.

The block diagram of FIG. 5 shows a system which is suitable for hardening plane workpieces of low thickness and small to medium dimensions.

The system has the following significant components:

a heating device 2 as first treatment station;

a quenching press 4 as second treatment station;

a tempering device 6 as third treatment station;

a cooling device 8 as fourth treatment station.

The heating device 2, the quenching press 4, the tempering device 6, and the cooling device 8 are arranged horizontally next to each other in such a way that workpieces 10 to be treated are moved in the direction of arrows $F_1$, $F_2$, and $F_3$ from the first through the fourth treatment station and, in each case, can be introduced into the individual treatment stations from below.

Heating device 2 is designed as a plate inductor 12 with two plates 14 and 16 standing opposite each other, with plates 14 and/or 16 being provided with retractable stops 18 such as ceramic pins which can be retracted or folded out for holding workpiece 10. Plates 14 and 16 are energized by means of an oscillating circuit 20. Moreover, a probe 22 is provided for the contact-free measurement of the end temperature. The test values supplied by test probe 22 are fed into a central process control unit.

Furthermore, heating device 2 can be equipped with a protective gas device 24, indicated by a broken line, for heating in a protective gas atmosphere.

Arranged next to heating device 2, on the same level, is quenching press 4 with a coolable mold 26 which has a first horizontally movable mold part 28 provided with a cooling device 30 for indirect cooling, and a second, stationery mold part 32 situated on the same level and provided with a second cooling device 34 for indirect cooling. In addition, retractable stops exist, in particular centering pins 36 for holding workpiece 10. First cooling device 30 and second cooling device 34 are expediently connected to a common coolant circuit, which may be connected to a control device for adjusting the coolant temperature.

Arranged on the same level, next to quenching press 4, is tempering device 6 with a heatable mold 38 which consists of a horizontally movable first mold part 40, which can be heated by a first heating device 42, and a second mold part 44, which can be heated by a second heating device 46. For holding workpiece 10, retractable stops or centering pins 48 are provided. In order to achieve locally differentiated heating of workpiece 10, second mold part 44 is provided with a recess 50, by which a direct heat transfer is avoided. Moreover, a feeding device 51 for blowing in compressed air is provided. First heating device 42 and second heating device 46 are connected to a control unit 52 for controlling the temperature/time response.

Following tempering device 6, on the same level, cooling device 8 with a coolable mold 56 is arranged. In its structure, it corresponds essentially to quenching press 4 and has the purpose of assuring distortion-free cooling of a formed and hardened/tempered workpiece 54 arriving from tempering device 6 in a chucked state and with controlled temperature/time response. Coolable mold 56 has a first horizontally movable mold part 58 which is provided with a first cooling device 60 for indirect cooling and, arranged at the same level, a second mold part 62 which is provided with a second cooling device 64 for indirect cooling. Additionally, retractable stops or centering pins 66 exist for holding workpiece 54. First cooling device 60 and second cooling device 64 are expediently connected to a common coolant circuit which can be connected to a control unit for controlling the coolant temperature.

Figure 6:
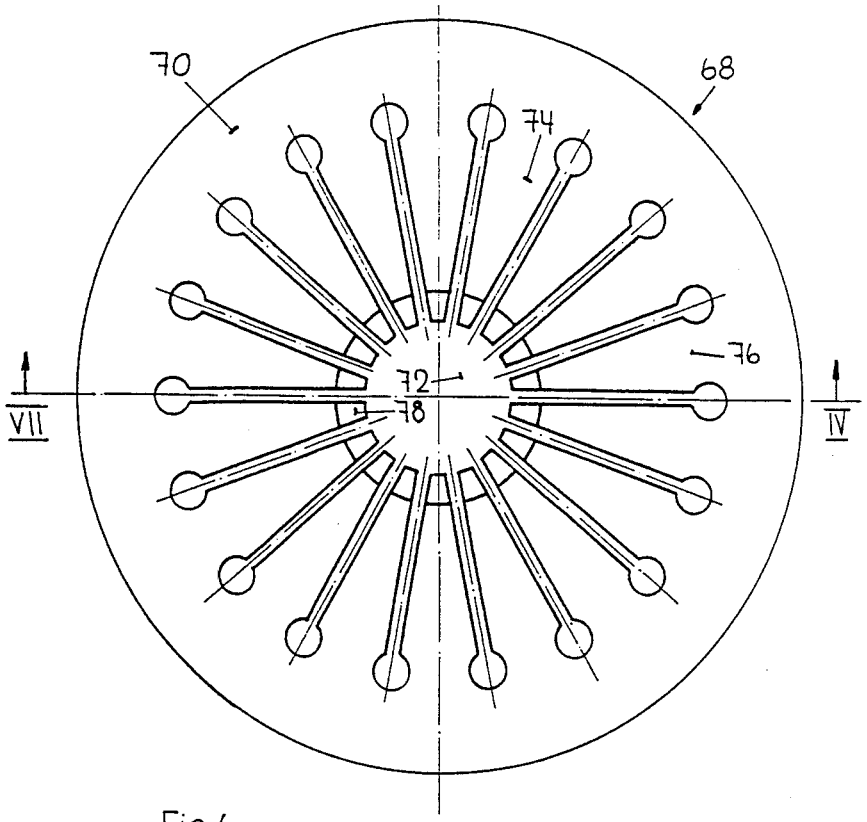
Figure 7:
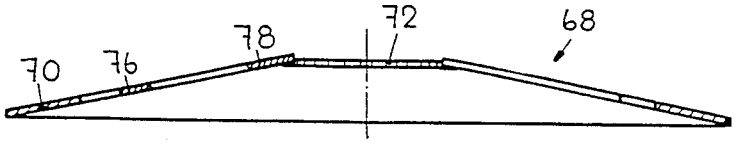

Preferably, the system is used for the manufacture of workpieces of low thickness such as a disk spring 68 in accordance with FIG. 6. Disk spring 68 has an outer closed annular part 70 and a central opening 72 from which radially running incisions extend to the annular part, thereby forming lamellae 74 running radially from annular part 70 to opening 72. As shown in FIG. 7, disk spring 68 has zones of varying hardness. Thus, for example, the hardness in annular part 70 and an adjacent area 76 of lamellae 74 is of a hardness near 42 to 45 HRC and in an area 78 adjacent to central opening 72 of a hardness near 58 to 60 HRC.

The manufacture of disk spring 68 is carried out in the following manner:

Into the first treatment station, heating device 2, which contains plate inductor 12, in each case, a disk spring 68 existing in the form of a slug manufactured by punching it from sheet steel of a thickness of 1.5 to 2.5 mm is introduced. Disk spring 68 may be taken from a supply of slugs stacked on a support such as a round turntable by means of magnetic grippers, for instance, and introduced into plate inductor 12 from below. By means of the retractable stops 18, disk spring 68 is held between plates 14 and 16 of the plate inductor. For this purpose, stops 18 are preferably designed in such a way that disk spring 68 can be turned during heating. By means of oscillating circuit 20, the plate inductor is subjected to a load of 60 kVA for instance and causes heating of disk spring 68 to its austenitizing temperature between 900° to 1100° C. The temperature response until the austenitizing temperature is reached is monitored by means of test probe 22. Test probe 22 is designed in such a way that it permits contact-free measuring of the tem-perature. The test values obtained are entered into a central program control unit and can be observed on a monitor and adjusted by means of a heating curve slope calculated or determined by testing for a specific structure.

As soon as the austenitizing temperature has been reached, which requires only a few seconds, 15 seconds for instance, disk spring 68 is released downward by retracting retractable stops 18 and transported to the second treatment station, quenching press 4, by means of a first conveying device 80 in accordance with FIG. 8. There, disk spring 68 is introduced from below into indirectly cooled mold 26 of quenching press 4 and held there by means of centering pin 36. By horizontally moving first mold part 28 in the direction of second mold part 32, form 26 is closed, disk spring 68 chucked and brought into the desired shape shown in FIGS. 6 and 7 in accordance with the pattern of mold 26 using a pressure of 6 Mp for example. In doing so, the plane slug is deformed into a cone-shell shape. In doing so, first mold part 28 is kept at the temperature required for quenching by means of cooling device 30, likewise the second mold part by means of second cooling device 34. For this purpose, temperature setting and maintenance can be carried out in such a way that both cooling devices are connected to one common coolant circuit provided with one control unit for temperature adjustment. In this respect, the temperature to be set in an individual case depends upon the mechanical properties to be attained and thus the desired structure, and it can be determined by calculation or by tests.

By opening mold 26 and pulling back centering pin 36, hardened disk spring 68 is released downward and, by means of a second conveying device 82 which matches the first one, transported to the third treatment station, tempering device 6, and chucked there in heatable mold 38. To accomplish this, chucking takes place by horizontal movement of first mold part 40 which has been heated to tempering temperature by means of first heating device 42 in the direction of second mold part 44 which is heated to tempering temperature by second heating device 46. As a result of recess 50 in mold part 44, (a recess)* which is arranged on the free ends of the lamellae 74 in area 78 adjacent to central opening 72, locally differentiated heating of disk spring 68 is achieved in such a way that only the area of annular part 70 and the adjacent area 76 are directly heated while heating of area 78 takes place exclusively by heat conduction inside disk spring 68. In doing so, an even greater localized heating differentiation can be achieved, if area 78 is additionally cooled by blowing in compressed air by means of feeding device 51. By heating—to 550° C. for instance—, the required hardness values are reached within a few seconds (accelerated tempering). This achieves that in area 78 the disk spring 68 demonstrates greater hardness than in the other areas. Heating devices 42 and 46 are additionally connected to control unit 52 which allows precise adjustment of the tempering temperature, in the range from 150° to 600° C. for instance, and of the duration of the tempering operation. The tempering temperature and/or duration of the tempering operation to be set in an individual case depends upon the structure to be achieved and the required mechanical properties and can be determined by tests or calculations. In this respect, it is true, for instance, that the lower the selected tempering temperature, the greater the hardness. With the accelerated tempering process, martensite embrittlement is avoided. With brief tempering periods of a few seconds at correspondingly higher temperatures, better mechanical properties are achieved. The temperature can be monitored by means of a test probe, and the test values obtained can be entered into a central control unit. In doing so, the temperature/time response can be observed by means of a monitor and adjusted by means of the slope of the heating curve calculated and/or determined by testing for a specific structure.

Subsequently, the formed and hardened disk spring 68 is released by opening heatable mold 38 and retracting centering pin 48, and by means of a third conveying device 84, which corresponds to the first and second conveying devices, conveyed to the fourth treatment station, cooling device 8, which is designed in accordance with quenching press 4. Disk spring 68 coming from the tempering device and supplied by conveying device 84 is introduced from below into coolable mold 56 of cooling device 8 and held there by means of centering pin 66. By horizontally moving first mold part 58 in the direction of second mold part 62, mold 56 is closed, and disk spring 68 is chucked and cooled in a chucked state by means of cooling devices 60 and 64 in accordance with a temperature-time curve calculated and/or determined by tests and stored in a central program control unit. After cooling, disk spring 68 is ready for use and characterized by a high dimensional precision and uniform structure so that it need not be subjected to any additional treatment steps.

During the entire process, all treatment stations are preferably traversed with the same cycle times. The cycle time to be used in the individual case is determined experimentally or by calculations and is adjusted in accordance with the duration of the operation requiring the greatest amount of time, as a rule, the quenching operation in the second treatment station, with the treatment in the other stations being adjusted to the predetermined cycle times. For this purpose, cycle times can last from a few seconds to a few minutes, depending upon the volume of the workpiece.

Figure 9:
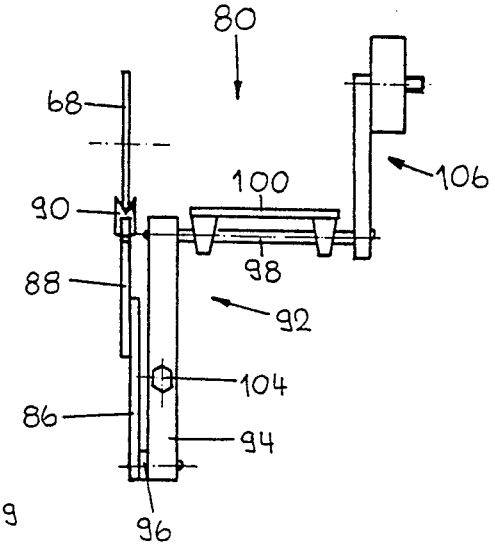

FIGS. 8 and 9 show conveying device 80 which is especially suitable for transferring preferably upright flat workpieces such as, in particular, disk springs 68 in accordance with FIGS. 6 and 7. Conveying device 80 contains a holder 86 with a cam 88 on which three grippers 90 are arranged along the arc of a circle, the radius of which corresponds to that of the disk springs.

The three grippers are provided with a material of reduced heat conductivity, at least on the forked part which acts in conjunction with the disk spring. Holder 86 is arranged on a parallelogram guide 92 which has two parallelogram arms 94 which are connected to holder 86 across bearings 96 on one side and on the other side with frame 100 of the system across shafts 98. On parallelogram arms 94, setscrews 102, 104 for adjusting the end settings of cam 88 are arranged. Connected to a shaft 98 is a drive unit 106, preferably connected to the central program control unit.

Cam 88 of the conveying device carries out a movement in the shape of a curve which, in the case at hand, forms an arc of a circle. The cam enters into a treatment station from below, grasps the lower portion of a workpiece such as a disk spring, which after retraction of stops in the treatment station can be freely removed downwards, along the arc of a circle to the next treatment station and there can be introduced again from below. After setting the stops in the treatment station, the workpiece is held in place, and the cam can again swing back freely downward to the preceding treatment station and pick up a new workpiece.

The system can also be designed in such a way that during the individual treatment steps, the workpieces are arranged horizontally and not upright as described in the preceding as an example. The horizontal arrangement is particularly recommended for workpieces of greater dimensions such as a diameter of approximately 0.5 m or more.

Figure 10:
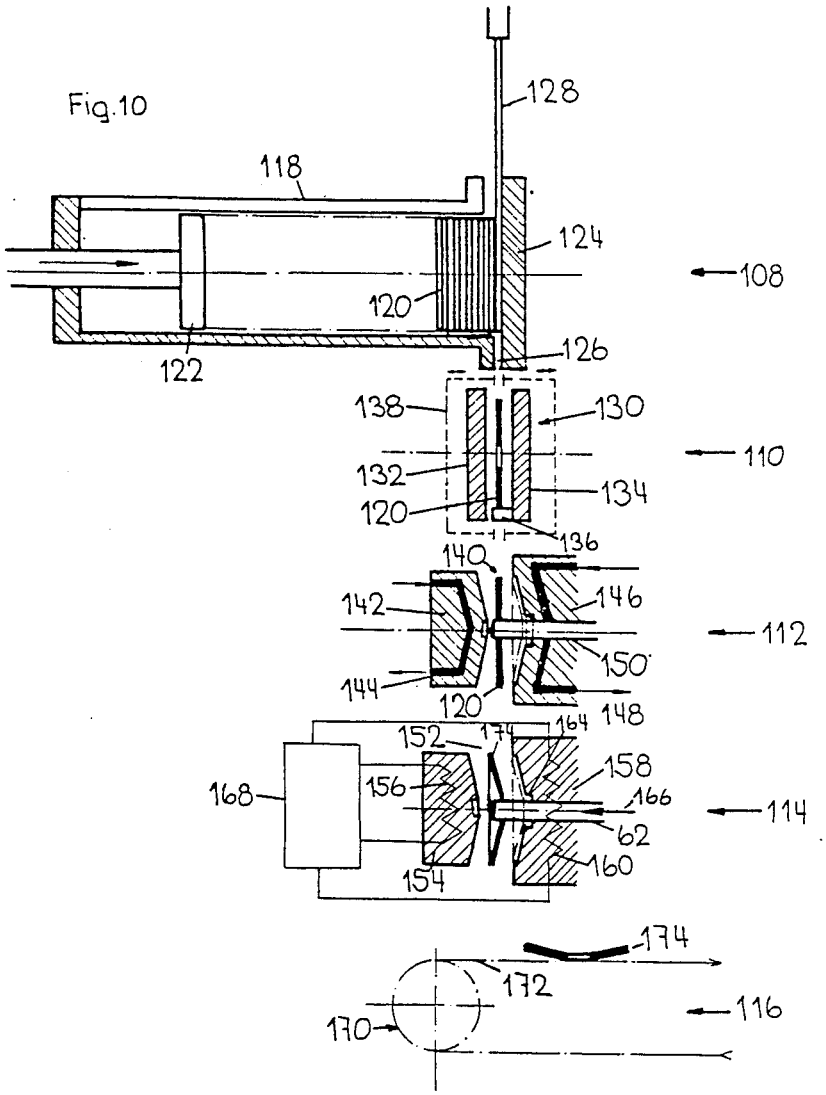

The block diagram of FIG. 10 shows a system which is suitable for hardening plane workpieces of small thickness.

The system exhibits the following significant components:

a feeding device 108 for supplying workpieces;
a heating device 110 as first treatment station;
a quenching press 112 as second treatment station;
a tempering device 114 as third treatment station; and
a removal device 116 for removing finished workpieces.

Feeding device 108, heating device 110, quenching press 112, tempering device 114, and removal device 116 are arranged vertically one above the other in this example in such a way that the workpieces pass through the system in free fall.

Feeding device 108 has a chamber 118 for receiving workpieces 120 and is provided with a pretensioning device 122 by means of which the workpieces 120 are pretensioned against an outlet side 124 and can be in the direction of a slot-shaped outlet opening 126. The latter has expediently a slot width which is greater than the thickness of workpiece 120 but smaller than twice the thickness of workpiece 120. Situated above outlet opening 126 is a discharge device 128 by means of which workpiece 120 can be discharged downward. Situated below outlet opening 126 is heating device 110, which is preferably designed as a plate inductor 130 with two plates 132 and 134 standing opposite each other, with plates 132 and/or 134 being provided with retractable stops 136, e.g. ceramic pins which can be pulled back of folded out, for holding workpiece 120.

In addition, heating device 110 can be provided with a protective gas device 138—indicated by broken lines—for heating in a protective gas atmosphere.

Situated below heating device 110 is quenching press 112 with a coolable mold 140 which has a horizontally movable first mold part 142 which is provided with a first cooling device 144 for indirect cooling and a stationary second mold part 146, arranged on the same level, which is provided with a second cooling device 148 for indirect cooling. In addition, a centering pin 150 exists for holding workpiece 120. First cooling device 144 and second cooling device 148 are expediently connected to a common coolant circuit which can be connected to a control unit for adjusting the coolant temperature.

Situated below quenching press 112 is tempering device 114 with a heatable mold 152 which consists of a horizontally movable first mold part 154 which can be heated by a first heating device 156, and a second mold part 158 which can be heated by a second heating device 160. For holding workpiece 120, a centering pin 162 is provided. In order to achieve locally differentiated heating of workpiece 120, second mold part 158 is provided with a recess 164, by means of which a direct heat transfer is avoided. In addition, a feeding device 166 is provided for blowing in compressed air. First heating device 156 and second heating device 160 are connected to a control unit 168 for controlling the temperature-time response.

Situated below tempering device 114 is a removal device 116, e.g. a conveying device 170, preferably a conveyor belt 172, for removal of finished workpieces 174. For this purpose, conveyor belt 172 can be designed simultaneously as cooling path for the formed and hardened workpieces 174.

The system is preferably used for the manufacture of workpieces of low thickness and very small dimensions in the range of a few centimeters.

Generally, the thermomechanical treatment is carried out without the use of a protective gas atmosphere. In particular cases, however, it is possible to provide either the first treatment station, i.e. the plate inductor, or the entire system with a protective gas device. Nitrogen technical is particularly suitable as protective gas.

REFERENCE CODE LIST

2: Heating device
4: Quenching press
6: Tempering device
8: Cooling device
10: Workpiece
12 Plate inductor
14: Plate
16: Plate
18: Retractable stop
20: Oscillating circuit
22: Test probe
24: Protective gas device
26: Coolable mold
28: First mold part
30: First cooling device
32: Second mold part
34: Second cooling device
36: Retractable stop or centering pin
38: Heatable mold
40: First mold part
42: First heating device
44: Second mold part
46: Second heating device
48: Retractable stop or centering pin
50: Recess
51: Compressed air feeding device
52: Control unit
54: Formed workpiece

56: Coolable mold
58: First mold part
60: First cooling device
62: Second mold part
64: Second cooling device
66: Retractable stop or centering pin
68: Disk spring
70: Annular part
72: Central opening
74: Lamella
76: Area adjacent to annular part
78: Area adjacent to central opening
80: First conveying device
82: Second conveying device
84: Third conveying device
86: Holder
88: Cam
90: Gripper
92: Parallelogram guide
94: Parallelogram arm
96: Bearing of 86
98: Shaft
100: Frame
102: Setscrew
104: Setscrew
106: Drive unit
108: Feeding device
110: Heating device
112: Quenching press
114: Tempering device
116: Removal device
118: Chamber
120: Workpiece
122: Pretensioning device
124: Outlet side
126: Outlet opening
128: Discharge device
130: Plate inductor
132: Plate
134: Plate
136: Retractable stop
138: Protective gas device
140: Coolable mold
142: First mold part
144: First cooling device
146: Second mold part
148: Second cooling device
150: Retractable stop or centering pin
152: Heatable mold
154: First mold part
156: First heating device
158: Second mold part
160: Second heating device
162: Retractable stop or centering pin
164: Recess
166: Compressed air feeding device
168: Control unit
170: Conveying device
172: Conveyor belt
174: Formed workpiece

I claim:

1. A process for low-distortion thermomechanical treatment of a workpiece of hardenable metallic material in mass production, said process comprising the steps of:

inductively heating the workpiece to its austenitizing temperature in a first treatment station including a heating device for heating the workpiece;

conveying the workpiece without substantial heat loss from the first work station to a second work station including a quenching press having at least one coolable mold for indirectly cooling a workpiece chucked therein;

forming the workpiece into a desired shape by chucking the workpiece in the quench press;

quenching the workpiece within the quench press to a predetermined temperature above room temperature in accordance with a first predetermined temperature-time relationship by indirect cooling without direct contract between the workpiece and a cooling liquid;

transferring the workpiece without substantial heat loss from the second work station to a third work station including a temperature device provided with at least one heatable mold, the tempering device including means for locally differentiated heat treatment of the workpiece;

chucking the workpiece in the heatable mold in order to maintain its desired shape therein;

subjecting the workpiece to locally differentiated heat treatment within the tempering device in accordance with a second predetermined time-temperature relationship so that selected portions of the workpiece are heated to selectively different temperatures;

transferring the workpiece without substantial heat loss from the third treatment station to a fourth treatment station including a cooling device having at least one coolable mold;

chucking the workpiece in the cooling device; and subjecting the workpiece within the cooling device to controlled cooling in accordance with a third predetermined temperature-time relationship.

2. The process as set forth in claim 1, said predetermined temperature above room temperature being below said austenitizing temperature and below said tempering temperature, said tempering temperature being lower than said austenitizing temperature.

3. The process as set forth in claims 1 or 2, further including the step of performing said conveying steps in a time period substantially less than the respective time periods during which the workplace resides in said respective work stations.

4. The process as set forth in claim 1, said coolable mold having means for circulating a liquid coolant flow therethrough.

5. The process as set forth in claim 4, said quenching step further including the step of selectively adjusting the liquid coolant temperature and liquid coolant flow rate in order to control the quenching of the workpiece in accordance with a predetermined temperature-time relationship.

6. The process as set fort in claims 4 or 5, said quenching step further including the step of continuously monitoring the temperature of the coolable mold, liquid coolant, and the workpiece for controlling the heat removal from the workpiece by the coolable mold.

7. The process as set forth in claim 1, said quenching step including the steps of quenching the surface temperature of the workpiece to a first predetermined temperature in accordance with a predetermined temperature-time relationship, and quenching the core of the workpiece to a second higher predetermined temperature in accordance with a predetermined temperature-time relationship, said tempering step including the step of selectively using an exterior heat source and the residual heat within the core of the workpiece for tempering the workpiece.

8. The process as set forth in claim 1, the quench press including means for selectively altering the pressure thereof, said quenching step further including the step of periodically changing the compression pressure of the quenching press in order to avoid stresses in the workpiece.

9. The process as set forth in claim 1, further including the step of defining a cycle time for passage of a workpiece through all of said treatment stations as a function of the operating time required for the treatment station with the longest treatment time, and passing subsequent workpieces through said treatment stations with the same cycle time for each workpiece.

10. The process as set forth in claim 1, said quenching step including the step of quenching the workpiece to a first predetermined temperature, maintaining the temperature of the workpiece within the quench press at first predetermined temperature for a predetermined time and subsequently cooling the workpiece in order to subject the workpiece to an isothermal heat treatment.

11. The process as set forth in claim 1, said quenching step including the steps of subjecting the workpiece to BY-treatment by quenching the workpiece to a first predetermined temperature and then subsequently cooling the workpiece to a second predetermined temperature in accordance with a predetermined temperature-time relationship.

12. The process as set forth in claim 1, said forming step including the step of forming the workpiece into a configuration having a curved portion, said cooling step including the steps of cooling the workpiece to approximately 200° C. in the cooling device, subsequently subjecting the workpiece to flattening excess pressure, and cooling the workpiece to room temperature.

13. The process as set forth in claim 1, said forming step including the step of forming the workpiece into the configuration of a disk spring of a thin sheet of steel with an outer closed annular part, a central opening, and lamellae extending radially toward the opening from the annular part, and successively repeating all of said steps for fully automatic mass production of said disk springs.

14. The process as set forth in claim 13, the tempering device including a recess defined therein for said locally differentiated heating of a workpiece chucked therein, said step of subjecting the workpiece to locally differentiated heat treatment including the steop of subjecting the workpiece in the vicinity of the free ends of the lamellae to heat treatment different than that of the remaining portion of the disk spring by selectively chucking the workpiece in the tempering device with the workpiece in the vicinity of the free ends of the lamellae within said recess thereby preventing direct heat transfer to sid lamellae portion and by flowing compressed air into the recess of the mold in order to expose the lamellae portion to heat treatment different from the remaining portion of the spring.

* * * * *

UNITED STATES PATENT AND TRADEMARK OFFICE

CERTIFICATE OF CORRECTION

PATENT NO. : 4,832,764

DATED : May 23, 1989

INVENTOR(S) : PETER MERZ

It is certified that error appears in the above-identified patent and that said Letters Patent is hereby corrected as shown below:

In the cover sheet, first column, insert the following --

[30] Foreign Application Priority Data
March 27, 1985 [CH] Switzerland . . . . . 1 334/85-8 --

Signed and Sealed this

Twentieth Day of February, 1990

*Attest:*

JEFFREY M. SAMUELS

*Attesting Officer*

*Acting Commissioner of Patents and Trademarks*